US010641200B2

(12) United States Patent
Oso et al.

(10) Patent No.: US 10,641,200 B2
(45) Date of Patent: May 5, 2020

(54) COOLING STRUCTURE OF WATER-COOLED ENGINE

(71) Applicant: KUBOTA Corporation, Osaka-shi, Osaka (JP)

(72) Inventors: Hiroki Oso, Sakai (JP); Takahiro Yamazaki, Sakai (JP); Hideyuki Koyama, Sakai (JP); Rina Kaneko, Sakai (JP); Yoshinori Tanaka, Sakai (JP); Takashi Yamaguchi, Sakai (JP); Akira Tanaka, Sakai (JP)

(73) Assignee: KUBOTA Corporation, Osaka-shi, Osaka (JP)

( * ) Notice: Subject to any disclaimer, the term of this patent is extended or adjusted under 35 U.S.C. 154(b) by 104 days.

(21) Appl. No.: 15/827,670

(22) Filed: Nov. 30, 2017

(65) Prior Publication Data

US 2018/0179984 A1 Jun. 28, 2018

(30) Foreign Application Priority Data

Dec. 28, 2016 (JP) ..... 2016-256243

(51) Int. Cl.
*F02F 1/10* (2006.01)
*F01P 11/04* (2006.01)
(Continued)

(52) U.S. Cl.
CPC *F02F 1/10* (2013.01); *F01P 3/02* (2013.01); *F01P 11/04* (2013.01); *F02F 1/14* (2013.01);
(Continued)

(58) Field of Classification Search
CPC ..... F02F 1/10; F02F 1/14; F02F 2001/106; F01P 3/02; F01P 11/04; F01P 2003/021
(Continued)

(56) References Cited

U.S. PATENT DOCUMENTS 5,188,071 A * 2/1993 Han ..... F02F 1/108 123/195 R
2014/0209046 A1* 7/2014 Steiner ..... F01P 5/10 123/41.31

FOREIGN PATENT DOCUMENTS

JP H09144596 A * 11/1955
JP S5717973 A 1/1982
(Continued)

OTHER PUBLICATIONS

Extended European Search Report dated Mar. 26, 2018 in EP Application No. 17199286.0.
(Continued)

*Primary Examiner* — Joseph J Dallo
*Assistant Examiner* — Yi-Kai Wang
(74) *Attorney, Agent, or Firm* — Panitch Schwarze Belisario & Nadel LLP

(57) ABSTRACT

A cooling structure of a water-cooled engine includes: a plurality of cylinders 2 arranged in a cylinder block 1; and a water jacket W formed around the plurality of cylinders 2. The water jacket W includes a pair of main flow paths 7, 8 formed in a state of extending in a cylinder arrangement direction outside the cylinders, and inter-bore flow paths 9, 10 formed between adjacent cylinders 2 in a state of connecting the pair of main flow paths 7, 8. Guide walls 11*h*, 13*h*, capable of guiding the cooling water flowing in the main flow paths 7, 8 to the inter-bore flow paths 9, 10, are formed in the cylinder block 1.

3 Claims, 7 Drawing Sheets

(51) Int. Cl.
*F01P 3/02* (2006.01)
*F02F 1/14* (2006.01)

(52) U.S. Cl.
CPC ... *F01P 2003/021* (2013.01); *F02F 2001/106* (2013.01)

(58) Field of Classification Search
USPC ..... 123/41.72
See application file for complete search history.

(56) References Cited

FOREIGN PATENT DOCUMENTS

| | | | | |
|---|---|---|---|---|
| JP | S59043918 | A | | 3/1984 |
| JP | H09144596 | A | * | 11/1995 |
| JP | H0828342 | A | | 1/1996 |
| JP | H08158932 | A | | 6/1996 |
| JP | H10196449 | A | * | 1/1997 |
| JP | H09144596 | A | | 6/1997 |
| JP | H10196449 | A | | 7/1998 |
| JP | 200393836 | A | | 7/2003 |
| JP | 2006105019 | A | | 4/2006 |
| JP | 2007023824 | A | | 2/2007 |

OTHER PUBLICATIONS

Office Action dated Oct. 9, 2019 in JP Application No. 2016-256243.

* cited by examiner

COOLING STRUCTURE OF WATER-COOLED ENGINE

BACKGROUND OF THE INVENTION

(1) Field of the Invention

The present invention relates to a cooling structure of a water-cooled engine, which is applied to industrial diesel engines and the like.

(2) Description of Related Art

Conventionally, there has been employed a unit for forming a water path by making a drilled hole in a portion between the bores of the cylinders by post-processing.

Or, there has been employed a unit for clearly separating adjacent cylinders by using core chaplet or the like and providing a clear water jacket between the bores to further improve the cooling performance.

SUMMARY OF THE INVENTION

In the former conventional art, by the addition of the drilled holes, the cooling water has been allowed to pass between the bores to improve the cooling performance. However, in the case of a higher thermal load such as a high compression engine or a large displacement engine, it is desirable to strengthen cooling between the bores. In the latter conventional art, although the cooling performance can be enhanced, a distance is required between the bores accordingly, resulting in the tendency to increase the length of the engine, which has been problematic.

As described above, the cooling structure of the conventional water-cooled engine has advantages and disadvantages in terms of preventing the increase in engine length and improving the cooling performance.

An object of the present invention is to provide a cooling structure of a water-cooled engine which enables sufficient cooling between bores without causing an increase in engine length by a further structural device, to achieve reduction in engine length as well as cooling performance.

An invention according to the present invention is a cooling structure of a water-cooled engine, including: a plurality of cylinders arranged in a cylinder block; and a water jacket formed around the plurality of cylinders. The water jacket includes a pair of main flow paths formed in a state of extending in a cylinder arrangement direction outside the cylinders, and inter-bore flow paths formed between adjacent cylinders in a state of connecting the pair of main flow paths. Guide walls, capable of guiding the cooling water flowing in the main flow paths to the inter-bore flow paths, are formed in the cylinder block.

According to the present invention, the guide wall capable of guiding the cooling water flowing in the main flow path to the inter-bore flow path is provided, thereby promoting the water intake action that promotes taking more cooling water into the inter-bore flow path by the guide wall. With this smooth flow of the cooling water, a sufficient flow rate (a flow rate per unit time of cooling water) is ensured in the inter-bore flow path, and even a place between the bores, which is difficult to be cooled, can be efficiently cooled without increasing the arrangement interval of the cylinders.

Consequently, it is possible to provide a cooling structure of a water-cooled engine which enables sufficient cooling between bores without causing an increase in engine length by a further structural device, to achieve reduction in engine length as well as cooling performance.

BRIEF DESCRIPTION OF THE DRAWINGS

FIG. 5A shows the case of the flow by guide walls in opposite directions to each other (first embodiment), and FIG. 5B shows the case of the flow by guide walls in the same direction as each other (second embodiment);

DETAILED DESCRIPTION OF PREFERRED EMBODIMENTS

Hereinafter, an embodiment of a cooling structure of the water-cooled engine according to the present invention will be described with reference to the drawings as applied to a vertical straight three-cylinder water-cooled diesel engine.

Figure 1:
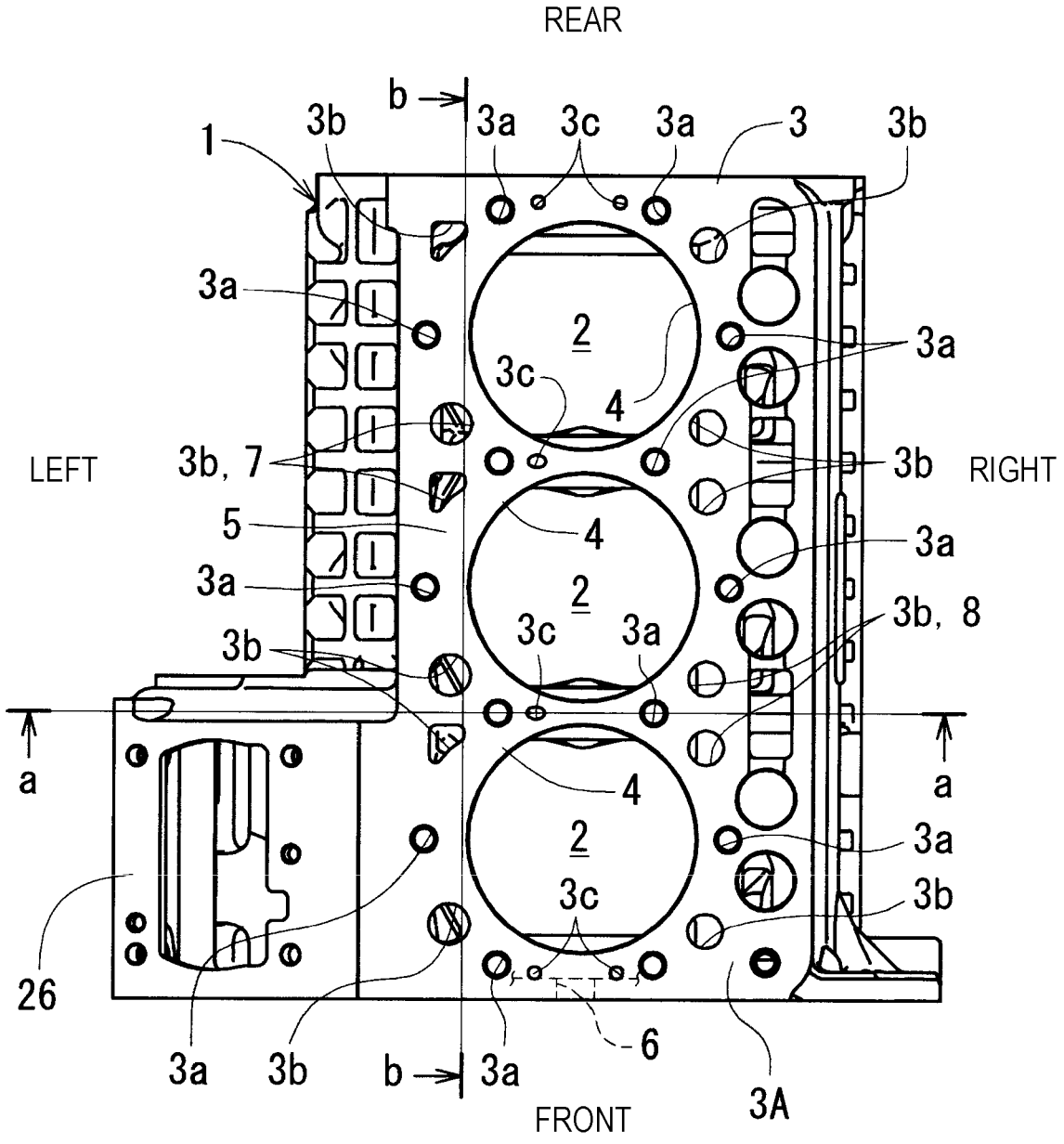
FIG. 1 is a plan view of a cylinder portion showing a cylinder block.
Figure 4:
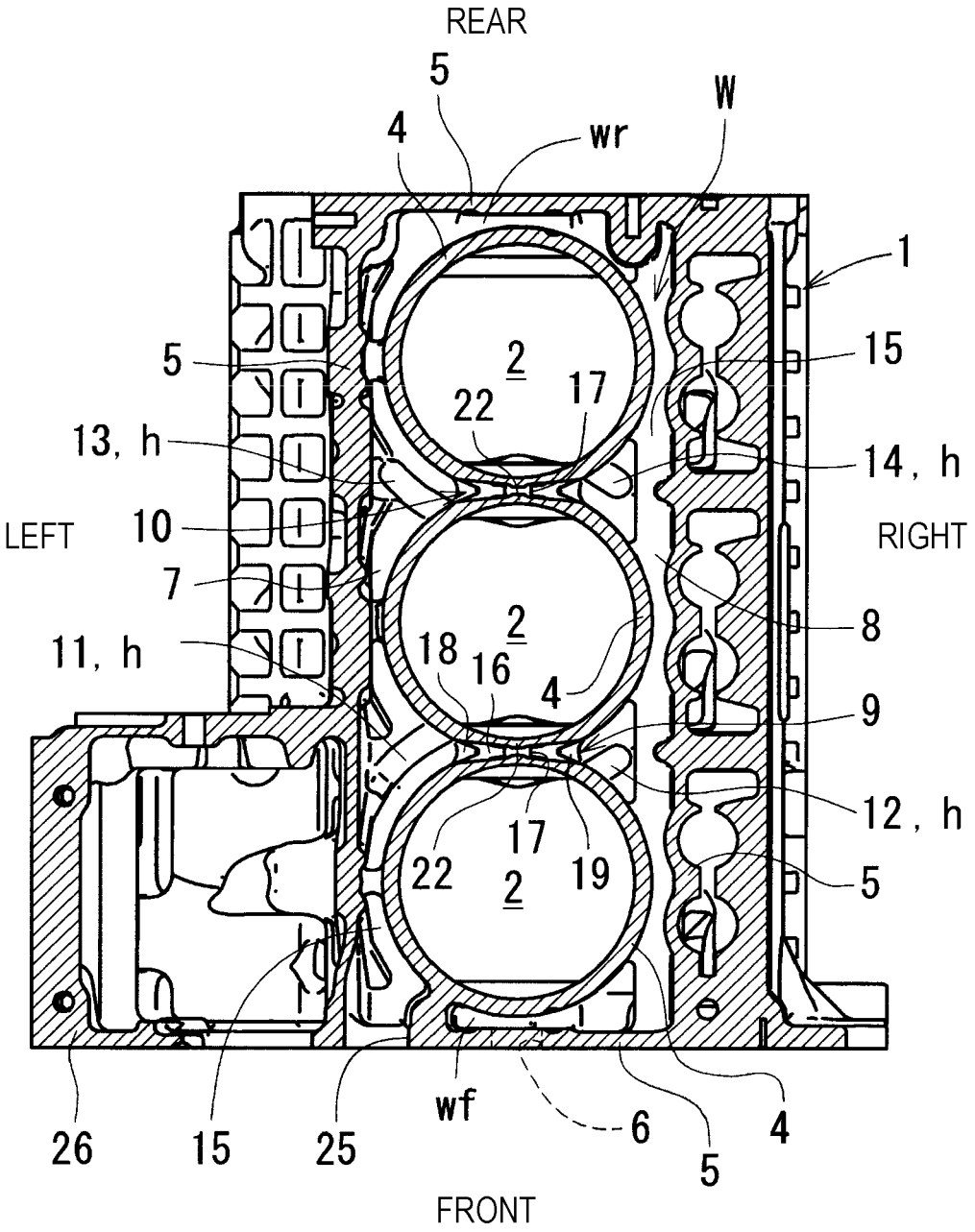
FIG. 4 is a cross-sectional view taken along a line c-c of the cylinder block shown in FIG. 2.

As shown in FIGS. 1 and 4, this engine is configured to be a water-cooled engine provided with a plurality of (three) cylinders 2 arranged in series in a cylinder block 1, and a water jacket (cylinder jacket) W formed around the plurality of cylinders 2. The water jacket W is an interior space for circulating the cooling water which is formed by barrel portions (cylinder walls) 4, 4, 4 formed upright in a substantially cylindrical shape forming the respective cylinders 2 in the cylinder block 1, a cylinder outer frame portion 5 in the cylinder block 1, and a cylinder top wall 3. A portion protruding to the left side on the front side of the cylinder block 1 is a fuel injection case portion 26.

In FIGS. 1 and 4, it is assumed that the intake side of the cylinder block 1 is left, the exhaust side of the same is right, the side where a cooling water inlet 6 to the water jacket W is located is front, and the opposite side thereto is rear.

The water jacket W includes an intake-side main flow path 7 and an exhaust-side main flow path 8, that are a pair of main flow paths formed on the outside of the cylinders 2 (barrel portions 4) in the state of extending in the cylinder arrangement direction, first and second inter-bore flow paths 9, 10 formed between the adjacent cylinders 2 (barrel portions 4) in the state of connecting the pair of main flow paths 7,8, and front and rear end flow paths wf, wr connecting the start end and the terminal end of the main flow paths 7, 8.

As shown in FIGS. 1 and 4, bolt insertion holes 3*a*, communication holes 3*b*, and drilled holes 3*c* are formed in a cylinder top wall 3 that connects a cylinder head (not shown) to its upper surface 3A via a gasket (not shown). The bolt insertion holes 3*a* are holes, through which bolts for connecting the cylinder block 1 and the cylinder head (not shown) and the like are passed, and opened at a plurality of places (14 places) around each cylinder 2. The communication holes 3*b* are relatively large paths for allowing the cooling water to flow from the water jacket W to the water jacket of the cylinder head (cylinder head jacket, not shown) and formed in a plurality of places (12 places) in the state of communicating with any one of the main flow paths 7, 8.

The drilled holes 3*c* are formed at a total of four places, at front and rear ends of the cylinder top wall 3 in the state of communicating with the front end flow path wf and the rear end flow path wr of the water jacket W, respectively. Further, the drilled holes 3*c* are formed as oblique holes extending from the upper left to the lower right at each place in the state of communicating with the first inter-bore flow path 9 and the second inter-bore flow path 10, respectively, between the adjacent cylinders 2, 2 of the cylinder top wall 3.

Figure 3:
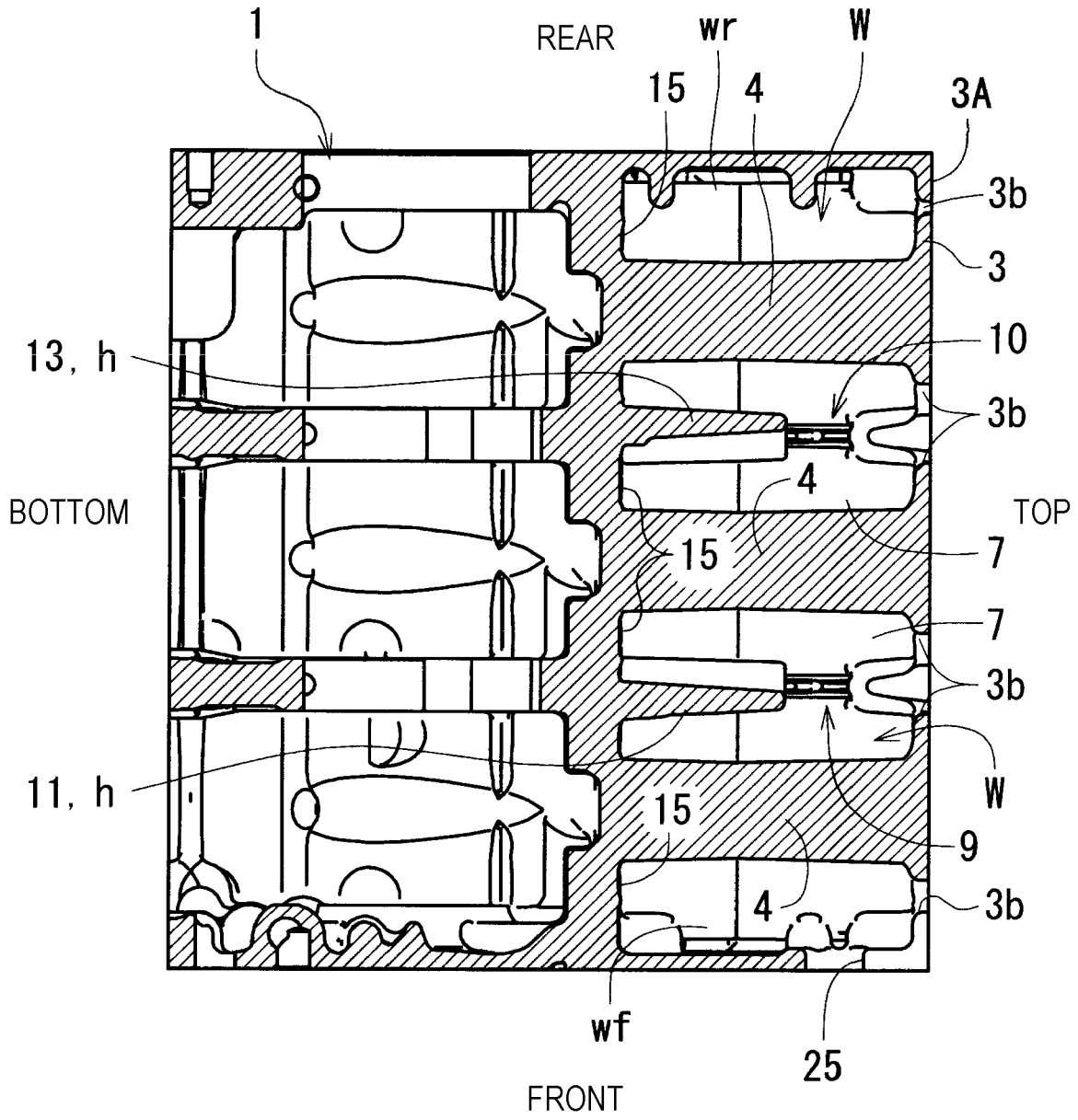
FIG. 3 is a cross-sectional view taken along a line b-b of the cylinder block shown in FIG. 1.

In FIGS. 3 and 4, the hole provided at the front end of the cylinder block 1 so as to face the front end flow path wf may be a mounting hole 25 for mounting an auxiliary device such as a thermostat (not shown) and a sensor (not shown) for measuring a cooling water temperature.

The cooling water, conveyed from the cooling water inlet 6 to the water jacket W by a water pump (not shown), first separates into right and left from the front end flow path wf, then flows rearward in the intake-side main flow path 7 and the exhaust-side main flow path 8, and in the middle thereof also flows in the first and second inter-bore flow paths 9, 10. The cooling water then flows upward while flowing rearward in the water jacket W, flows through the communication holes 3*b* at a plurality of places and the drilled holes 3*c* at a plurality of places, flows into the cylinder head jacket (not shown), and flows toward a cooling water outlet (not shown) of the cylinder head.

First Embodiment

Figure 5A:
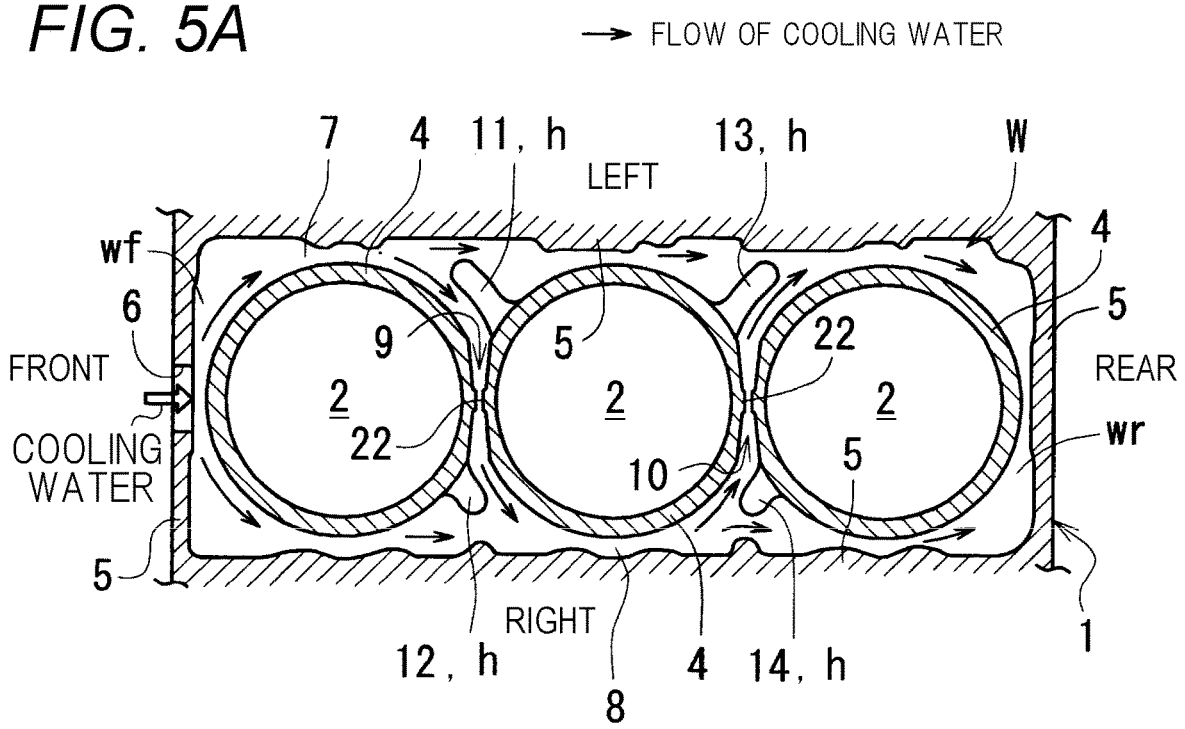
FIGS. 5A and 5B each show a flow of cooling water in a water jacket, where

As shown in FIGS. 4 and 5A, guide walls h (11 to 14) are formed in four places in the cylinder block 1, the guide walls h being capable of guiding the cooling water flowing in the main flow paths 7, 8 to the inter-bore flow paths 9, 10. Specifically, the guide walls h are made up of a first guide wall 11 protruding from the front side portion of the intermediate second barrel portion 4 to the intake-side main flow path 7, a second guide wall 12 protruding from the rear side portion of the front-side first barrel portion 4 to the exhaust-side main flow path 8, a third guide wall 13 protruding from the rear side portion of the intermediate second barrel portion 4 to the intake-side main flow path 7, and a fourth guide wall 14 protruding from the front side portion of the rear-side third barrel portion 4 to the exhaust-side main flow path 8.

By the first guide wall 11 having an arc-shape along the circumferential direction of the front-side first cylinder 2, there is exerted a guide action of guiding cooling water, which flows from the front to the rear in the intake-side main flow path 7 by the first cylinder 2, rightward to the first inter-bore flow path 9. By the second guide wall 12 having an arc-shape along the circumferential direction of the intermediate second cylinder 2, there is exerted a guide action of merging cooling water, which flows from left to right (from the intake side to the exhaust side) in the first inter-bore flow path 9, into the exhaust-side main flow path 8 while guiding the cooling water obliquely rearward right.

By the fourth guide wall 14 having an arc-shape along the circumferential direction of the second cylinder 2, there is exerted a guide action of guiding cooling water, which flows from the front to the rear in the exhaust-side main flow path 8 by the second cylinder 2, leftward to the second inter-bore flow path 10. By the third guide wall 13 having an arc-shape along the circumferential direction of the rear-side third cylinder 2, there is exerted a guide action of merging cooling water, which flows from right to left (from the exhaust side to the intake side) into the intake-side main flow path 7 in the second inter-bore flow path 10, while guiding the cooling water obliquely rearward left.

As described above, the first guide wall 11 and the third guide wall 13 corresponding to the inter-bore flow paths 9, 10, which are adjacent to each other in the cylinder arrangement direction, respectively, are formed so as to guide the cooling water to the inter-bore flow paths 9, 10 in the opposite directions to each other. The second guide wall 12, which regulates the entry of the cooling water flowing in the exhaust-side main flow path 8 into the first inter-bore flow path 9, and the fourth guide wall 14, which promotes the entry of the cooling water flowing in the exhaust-side main flow path 8 into the second inter-bore flow path 10, are formed with the guide actions in the opposite directions to each other.

As a result, in the water jacket W, as shown in FIG. 5A, the cooling water is guided so as to generate, by the guide actions of the first to fourth guide walls 11 to 14, flows in the pair of main flow paths 7, 8 from the front to the rear, a flow in the first inter-bore flow path 9 from left to right, and a flow in the second inter-bore flow path 10 from right to left. Due to this smooth flow of the cooling water, a sufficient flow rate (as well as a flow rate per unit time of the cooling water) is ensured in the first and second inter-bore flow paths 9, 10, and it is possible to realize a configuration capable of efficiently cooling a place between the bores, which is difficult to be cooled, without widening the arrangement interval of the cylinders 2, 2.

That is, since the first inter-bore flow path 9 exerts the cooling-water intake (water-intake) promotion action by the first guide wall 11 and the drainage promotion action by the second guide wall 12, it is possible to obtain an efficient water cooling effect through a sufficient flow rate without increasing the width between the bores. Similarly, since the second inter-bore flow path 10 exerts the cooling-water intake (water-intake) promotion action by the third guide wall 13 and the drainage promotion action by the fourth guide wall 14, it is possible to obtain an efficient water cooling effect through a sufficient flow rate without increasing the width between the bores.

In the cooling structure of the water-cooled engine according to the first embodiment, the guide walls 11(*h*), 13(*h*) corresponding to the inter-bore flow paths 9, 10, which are adjacent to each other in the cylinder arrangement direction, respectively, are formed in the state of guiding the cooling water to the inter-bore flow paths 9, 10 in the opposite directions to each other. Hence the movement route for the cooling water flowing in the two inter-bore flow paths 9, 10 can be made long, to thereby efficiently exert the heat absorption action by the cooling water.

Further, since the guide wall h is formed in an arc-shape concentric or substantially concentric with the cylinder bores of the inter-bore flow paths 9, 10 to which the cooling water is to be conveyed, it is possible to more smoothly convey the cooling water into the inter-bore flow paths 9, 10.

Figure 2:
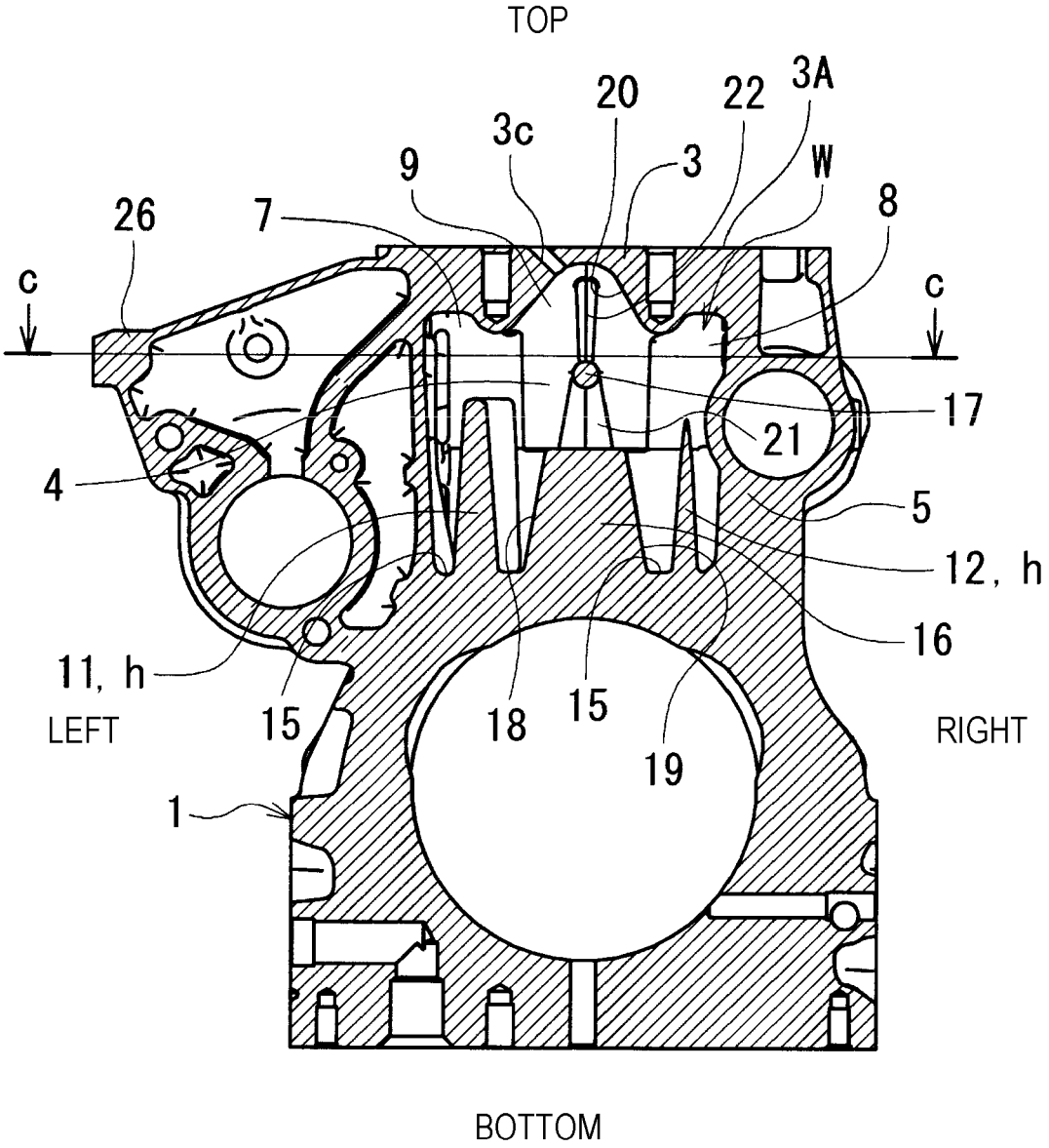
FIG. 2 is a cross-sectional view taken along a line a-a of the cylinder block shown in FIG. 1.

As shown in FIGS. 2 and 3, the water jacket W has a jacket bottom 15 to have a depth (vertical width) substantially equal to the vertical length of the barrel portion 4.

As shown in FIG. 2, between the bores, a block wall 16 for integrating the lower half portions of the adjacent barrel portions 4, 4 is formed so as to extend upward from the jacket bottom 15, and a point connecting wall 17 for integrating the upper portions of the adjacent barrel portions 4, 4 with a small cross-sectional area is formed.

As shown in FIG. 2, the block wall 16, being horizontally long and longitudinally short, is provided with right and left inclined side surfaces 18, 19 and is formed in a trapezoidal form having the shape of a truncated cone. Note that the inclined side surfaces 18, 19 may be formed on the vertical side surfaces and may have a rectangular block wall 16 in the longitudinal view. The cooling water going to flow into the inter-bore flow paths 9, 10 is guided by the inclined side surfaces 18, 19, and in the inter-bore flow paths 9, 10, a flow component flowing horizontally obliquely upward is promoted. As the upper surface of each of the inter-bore flow paths 9, 10 is formed in a curved ceiling surface 20 in an inverted bowl-like shape, in the inter-bore flow paths 9, 10, it is configured so as to promote the flow in a relatively upper part.

A lower rib wall 21 having a truncated trapezoidal shape formed protruding to the front and the rear from the barrel portion 4 is provided between the upper and lower portions of the block wall 16 and the point connecting wall 17. On the upper side of the point connecting wall 17, there is provided an upper rib wall 22 formed protruding to the front and the rear from the barrel portion 4. By the lower rib wall 21 and the upper rib wall 22, the route width (longitudinal width) of the inter-bore flow paths 9, 10 is restricted, and it is possible to exert the effect of advancing the flow velocity of the cooling water and the effect of guiding the cooling water upward.

Further, the drilled hole 3*c* vertically penetrating the cylinder top wall 3 in the horizontally intermediate upper portions of the inter-bore flow paths 9, 10 is formed as an inclined hole extending obliquely upward to the left from the bottom. Through the drilled hole 3*c*, the cooling water can also flow from the top of the inter-bore flow paths 9, 10 to the cylinder head jacket (not shown), increasing the flow velocity in the inter-bore flow paths 9, 10 and increasing the cooling area, so that the cooling efficiency can be enhanced.

Thus, in the water jacket W, the block wall 16 is provided in the lower half between the adjacent barrel portions 4, 4, and formed in the inter-bore flow paths 9, 10 with the cross-sectional area being about half the depth of each of the main flow paths 7, 8, in the state of being located in the upper portion of the cylinder 2. The barrel portions 4, 4 are integrated with each other by the block wall 16 and the point connecting wall 17 so as to contribute to improvement in strength and rigidity of the cylinder block 1.

As shown in FIGS. 2 and 3, the lower ends of the guide walls 11 to 14 are integrally formed so as to stand upright from the jacket bottom 15. The upper ends of the first and third guide walls 11, 13 are set so as to be located in the vertically intermediate positions of the inter-bore flow paths 9, 10, and have heights between ⅔ and ¾ of the vertical width (depth) of the water jacket W. The upper ends of the second and fourth guide walls 12, 14 are set so as to be located in the vertically intermediate positions of the inter-bore flow paths 9, 10 and slightly lower than the upper ends of the first and third guide walls 11, 13, and have heights between ½ to ⅔ of the vertical width (depth) of the water jacket W.

Second Embodiment

Figure 5B:
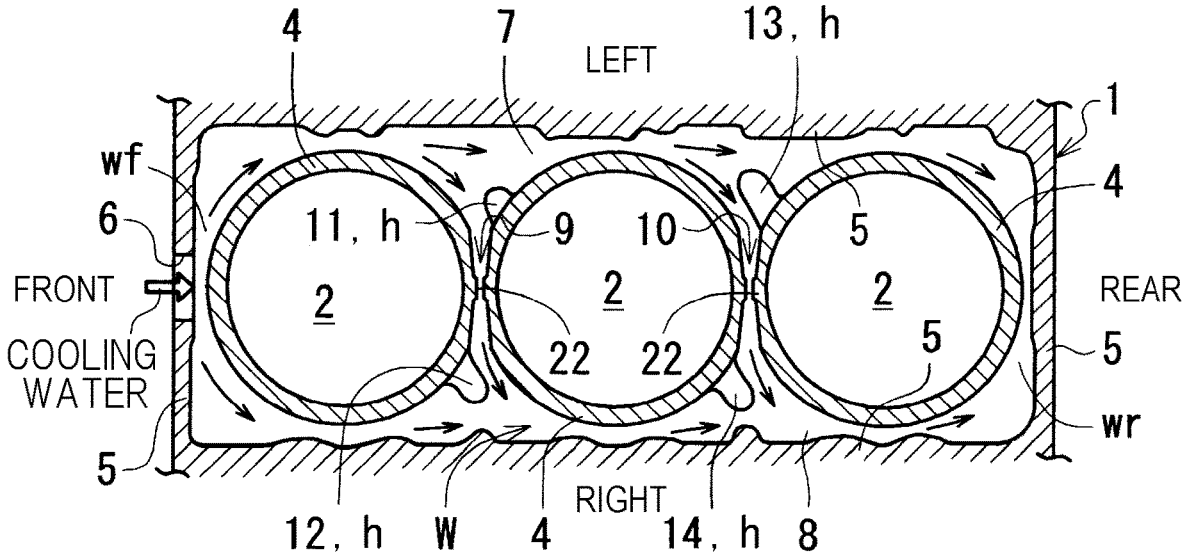

As shown in FIG. 5B, there may be employed a cooling structure in which the flow directions of the first and second inter-bore flow paths 9, 10 are the same as each other. That is, the third guide wall 13 has an arc-shape along the circumferential direction of the intermediate second cylinder 2 and is formed so as to protrude from the third barrel portion 4 to the intake-side main flow path 7. The fourth guide wall 14 has an arc-shape along the circumferential direction of the rear-side third cylinder 2 and is formed so as to protrude from the second barrel portion 4 to the exhaust-side main flow path 8.

In the cooling structure according to the second embodiment, the guide action is exerted by the third guide wall 13 so as to promote the flow for guiding the cooling water flowing in the intake-side main flow path 7 to the second inter-bore flow path 10. Then, the guide action is exerted by the fourth guide wall 14 to smoothly merge the cooling water, which flows from the intake side to the exhaust side (from left to right) in the second inter-bore flow path 10, into the exhaust-side main flow path 8 while guiding the cooling water to the obliquely rearward right.

That is, as shown in FIG. 5B, the cooling water is guided to flow from left to right (from the intake side to the exhaust side) in any of the inter-bore flow paths 9, 10 by the guide walls h (11 to 14). It is the same as the case of the first embodiment shown in FIG. 5A except that the flow direction in the second inter-bore flow path 10 is different. Although the flow direction is different from that in the first embodiment [see FIG. 5A], it is possible to achieve a similar effect with respect to the water cooling effect of the inter-bore flow paths 9, 10.

Further, as shown in FIG. 5B, it is convenient that the amount of protrusion of the first guide wall 11, closer to the cooling water inlet 6 than the third guide wall 13, to the intake-side main flow path 7 is made smaller than that of the third guide wall 13 to balance the flow rates of cooling water into the first and second inter-bore flow paths 9, 10 so as to make them equal to each other. A unit for making the height of the third guide wall 13 from the jacket bottom 15 (see FIG. 2) larger than that of the first guide wall 11 is also effective.

In the cooling structure of the water-cooled engine according to the second embodiment, the guide walls 11(*h*), 13(*h*) corresponding to the inter-bore flow paths 9, 10, which are adjacent to each other in the cylinder arrangement direction, respectively, are formed in the state of guiding the cooling water to the inter-bore flow paths 9, 10 in the same direction as each other. Therefore, the flows of the cooling water to the two inter-bore flow paths 9, 10 both become the flows from the intake-side main flow path 7 to the exhaust-side main flow path 8, and the cooling effect with higher efficiency can be obtained by the smooth flow in the water jacket W.

Third Embodiment

Figure 6:
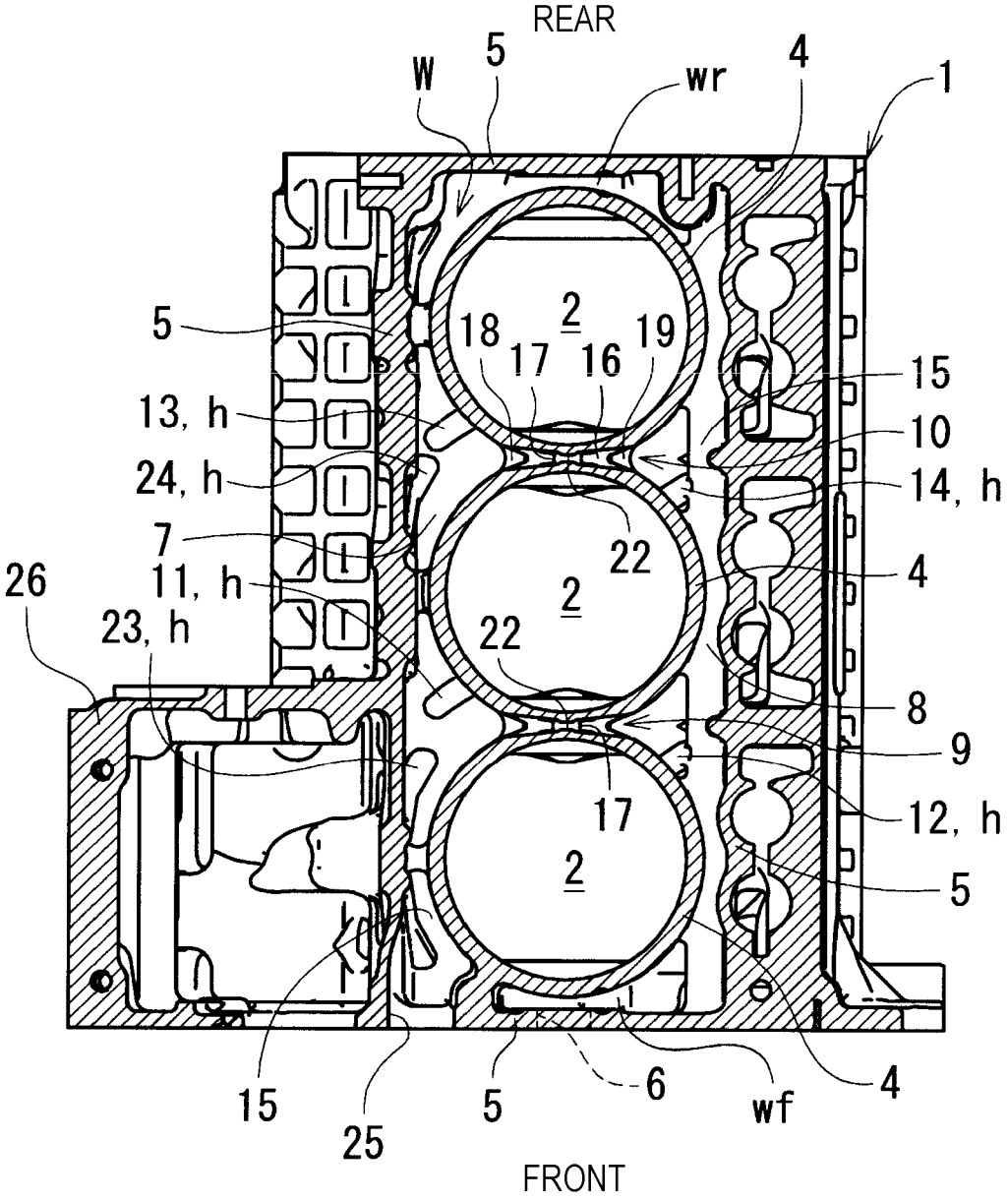
FIG. 6 is a transverse sectional view of a cylinder block showing a configuration of a guide wall according to a third embodiment.

As shown in FIG. 6, fifth and sixth guide walls 23 and 24, made up of rib walls, may be added to the guide walls h (11 to 14) of the second embodiment, to employ a cooling structure having a total of six guide walls h (11 to 14, 23, 24). That is, the fifth guide wall 23 is formed in the state of protruding to the intake-side main flow path 7, in an arc-shape concentric or substantially concentric with the first guide wall 11 in the vertical view and in a position slightly left forward away from the first guide wall 11, in the cylinder outer frame portion 5 located on the left side of the front-side first cylinder 2.

Then, the sixth guide wall 24 is formed in the state of protruding to the intake-side main flow path 7, in an arc-shape concentric or substantially concentric with the third guide wall 13 and in a position slightly left forward away from the third guide wall, in the cylinder outer frame portion 5 located on the left side of the intermediate second cylinder 2.

The fifth and sixth guide walls 23 and 24 are provided so as to support and strengthen the guide action of the cooling water to the inter-bore flow paths 9, 10 by the first and third guide walls 11, 13 on the upstream side thereof.

Hence the guide walls h (11 to 14, 23, 24) according to the third embodiment have the effect of promoting taking the cooling water into the inter-bore flow paths 9, 10 by the guide walls h (11 to 14) according to the second embodiment.

In this case, as shown in FIG. 6, it is convenient to configure such that the separation distance between the first guide wall 11 and the fifth guide wall 23, which are closer to the inlet, is made longer than the separation distance between the third guide wall 13 and the sixth guide wall 24 to balance the flow rates of cooling water into the first and second inter-bore flow paths 9, 10 so as to make them equal to each other. The flow condition of the cooling water in the water jacket W is basically the same as that in the second embodiment shown in FIG. 5B. That is, the guide walls h include arc-shaped rib walls 11, 13, 23, 24 along circumferential directions of the cylinders 2.

Since the guide walls h are formed in the cylinder outer frame portion 5 and the barrel portions 4, the guide walls h can be integrally molded at the time of manufacturing the cylinder block 1 by using a core formed so as to allow the integration. It is thus possible to provide guide walls h excellent in productivity and in a rational state with little cost increase.

Another Embodiment

Figure 7:
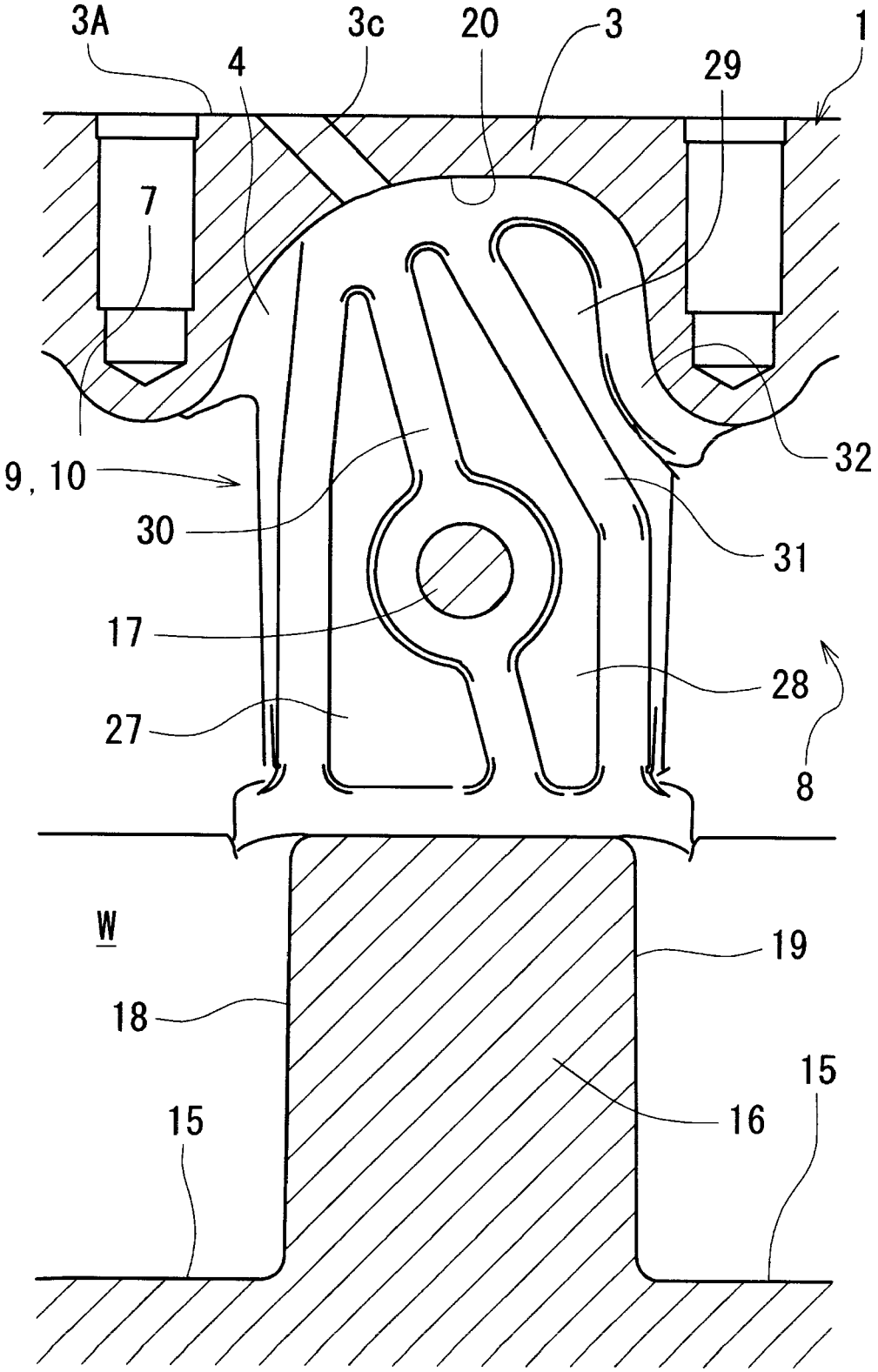
FIG. 7 is an enlarged front view of a main part showing another shape of the side wall in the inter-bore flow path.

The shape and structure of the side walls of the inter-bore flow paths 9, 10 shown in FIG. 2, namely, the outer circumferential wall of the barrel portion 4, may be changed to a state shown in FIG. 7. As shown in FIG. 7, on the outer peripheral wall of the barrel portion 4 of the second cylinder 2, a first rib portion 27 located on the intake side of the point connecting wall 17, a second rib portion 28 located on the exhaust side of the point connecting wall 17, and a third rib portion 29 located obliquely above the exhaust side of the second rib portion 28 are raised and formed.

An oblique recessed path 30 including a rounded portion of the point connecting wall 17 is formed between the first rib portion 27 and the second rib portion 28. A bent recessed path 31 with a vertical lower portion and an oblique upper portion is formed between the second rib portion 28 and the third rib portion 29. An S-shaped recessed path 32 is formed between the third rib portion 29 and the curved ceiling surface 20. Each of the recessed paths 30, 31, 32 is formed so that any terminal end (upper end) thereof faces the inter-bore flow path side opening (numeral is omitted) of the drilled hole 3*c*.

Accordingly, in the inter-bore flow paths 9, 10 where the first to third rib portions 27 to 29 as shown in FIG. 7 are formed on the side walls (barrel portions 4), the cooling water that flows in from the main flow paths 7 and 8 flows obliquely upward and is guided toward the drilled hole 3*c* by the first to third rib portions 27 to 29 and the respective recessed paths 30 to 32. As a result, the flow of the cooling water in each of the inter-bore flow paths 9, 10 is promoted, to enable more efficient cooling between the cylinder bores.

What is claimed is:

1. A cooling structure of a water-cooled engine, comprising:

a plurality of cylinders arranged in a cylinder block; and a water jacket formed around the plurality of cylinders, wherein the water jacket includes a pair of main flow paths formed in a state of extending in a cylinder arrangement direction outside the cylinders, and inter-bore flow paths formed between adjacent cylinders in a state of connecting the pair of main flow paths, and guide walls, capable of guiding the cooling water flowing in the main flow paths to the inter-bore flow paths, are formed in the cylinder block and in a cylinder outer frame portion that surrounds the water jacket in the cylinder block, and at least some of the guide walls are formed as arc-shaped rib walls along circumferential directions of the cylinders.

2. The cooling structure of the water-cooled engine according to claim 1, wherein the guide walls corresponding to the inter-bore flow paths, adjacent to each other in the cylinder arrangement direction, are formed in a state of guiding the cooling water to the inter-bore flow paths in opposite directions to each other.

3. The cooling structure of the water-cooled engine according to claim 1, wherein the guide walls corresponding to the inter-bore flow paths, adjacent to each other in the cylinder arrangement direction, are formed in a state of guiding the cooling water to the inter-bore flow paths in the same direction with each other.

* * * * *